US006000409A

United States Patent [19]

Chung

[11] Patent Number: 6,000,409

[45] Date of Patent: Dec. 14, 1999

[54] BARRETTE

[75] Inventor: Wen-Chien Chung, Tainan, Taiwan

[73] Assignee: Chian Tai Attire Enterprise Co., Ltd., Tainan, Taiwan

[21] Appl. No.: 09/305,368

[22] Filed: May 5, 1999

[30] Foreign Application Priority Data

Apr. 14, 1998 [TW] Taiwan ..... 87205582

[51] Int. Cl.[6] ..... A45D 8/22; A45D 8/04; A45D 8/12

[52] U.S. Cl. ..... 132/278; 132/273; 132/275

[58] Field of Search ..... 132/278, 273, 132/275, 276, 277, 279, 280, 281, 282, 283, 284; D28/33, 41

[56] References Cited

U.S. PATENT DOCUMENTS 3,678,946 7/1972 Katz ..... 132/278
5,318,054 6/1994 Neilson et al. ..... 132/273
5,566,690 10/1996 Shih-Ming ..... 132/276
5,775,345 7/1998 Chou ..... 132/278
5,913,316 6/1999 Chou ..... 132/278

*Primary Examiner*—John J. Wilson
*Assistant Examiner*—Robyn K Doan
*Attorney, Agent, or Firm*—Rosenberg, Klein & Bilker

[57] ABSTRACT

A barrette includes two decorative elongate plates of the same structure combined together. Each decorative plate has an insertable end portion, a two-holed end portion and an intermediate twisted portion. One decorative plate has its insertable end portion with two projections extending in the two holes portion of the other decorateive plate, with the intermediate portions intertwisting and overlapping with each other so that the two decorative elongate plates may be combined together in a stabilized condition, with the two projections respectively stopped by an upper edge and a lower edge of the two holes.

1 Claim, 3 Drawing Sheets

BARRETTE

BACKGROUND OF THE INVENTION

This invention relates to a barrette, particularly to one having two decorative elongate plates intertwisting and overlapping with each other, enabling the barrettes to have a variety of shapes and colors and cheap cost.

Generally, conventional barrettes have a C-shape affixed with various decorative paper or leather patterns on an outer surface to increase beautiful appearance and it is found popular wearing plural colorful barrettes; however, the barrettes cannot really combine with each other and they cost consumers more money to achieve the effect.

SUMMARY

The main objective of the invention is to offer a barrette consisting of two decorative elongate plates of the same structure, each of them has an insertable end portion provided with two stop projections, and the other end portion provided with a first hole and a second hole separated with a lateral wall, and an intermediate twisting portion. Then, the first of two decorative elongate plates has its insertable end extending from inside through the first hole of the second decorative plate and then continually from outside through the second hole. The intermediate portions of the two doecroative plates intertwist and overlap with each other with the insertable end of the second decorative plate extending from inside through the first hole of the first decorative plate and then continually from outside through the second hole, with the two stop projections stepped by an upper edge and a lower edge of the two holes,

BRIEF DESCRIPTION OF THE DRAWINGS

This invention will be better understood by reference to the accompanying drawings, wherein.

DETAILED DESCRIPTION OF THE PREFERRED EMBODIMENT

Figure 1:
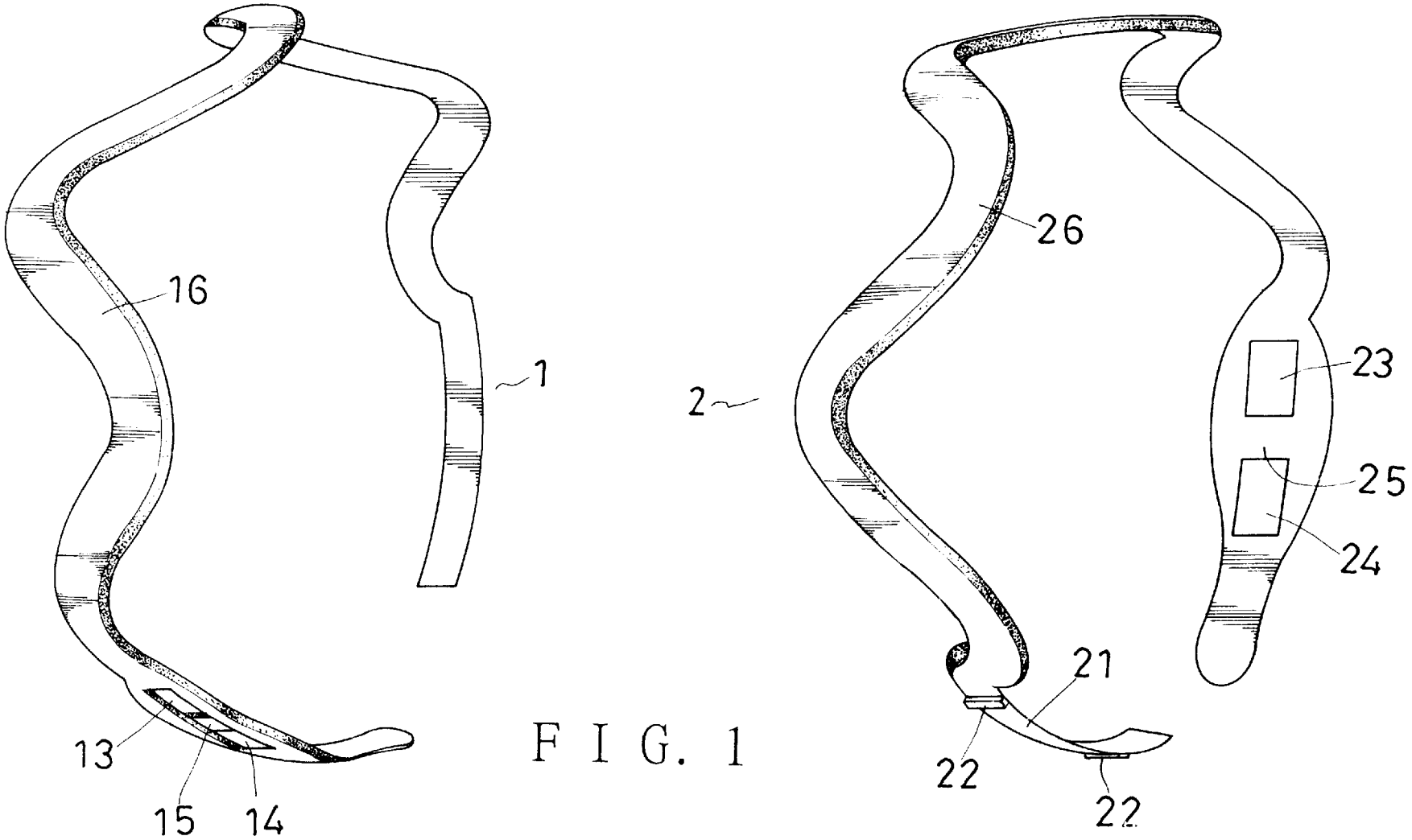
FIG. 1 is an exploded perspective view of a barrette of the present invention.
Figure 2:
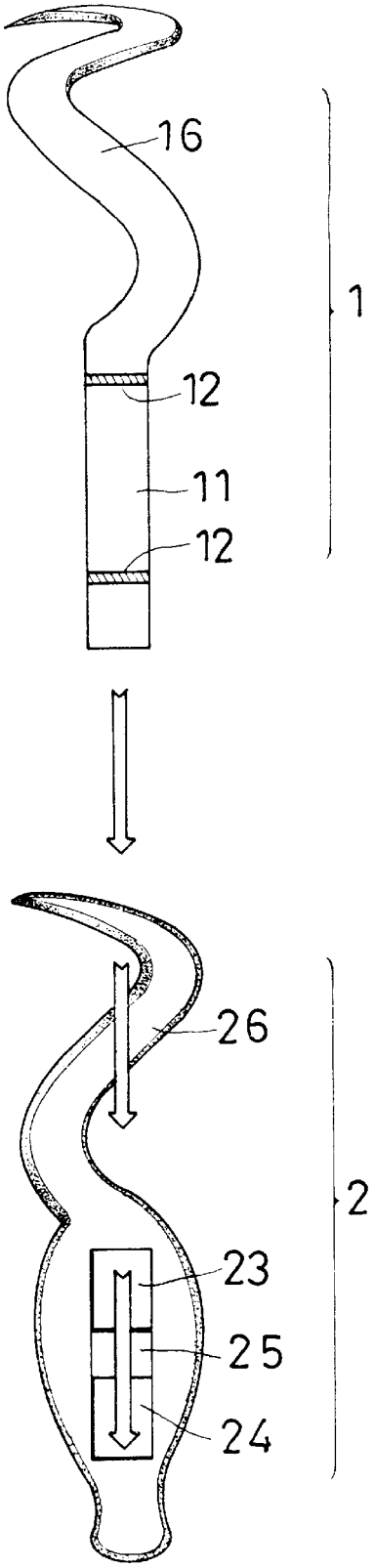
FIG. 2. is a side view of two decorative elongate plates about to be combined together of the present invention.
Figure 3:
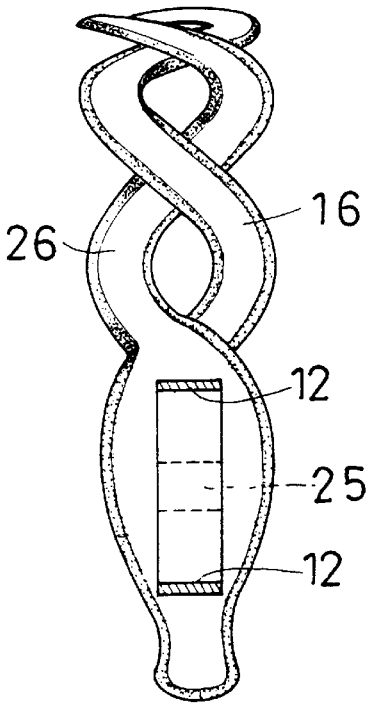
FIG. 3 is a side view of the two decorative elongate plates combined together of the present invention.

A preferred embodiment of the invention of the present invention, as shown in FIG. 1, includes a first decorative elongate plate 1 and a second decorative elongate plate 2 of the same structure combined together.

The first and the second decorative elongate plate 1 and 2 respectively has a flat insertable end portion 11 and 21, two lateral stop projections 12 and 22 protruding on an outer surface of the end portion 11 and 21, a first hole 13 and 23 and a second hole 14 and 24 formed on the other end portion and separated by a lateral wall 15 and 25. Further, the first and the second decorative elongate plate 1 and 2 respectively has an intermediate twisted portion 16 and 26 to intertwisting and overlapping with each other when the two decorative elongate plate 1 and 2 are combined together.

Figure 5:
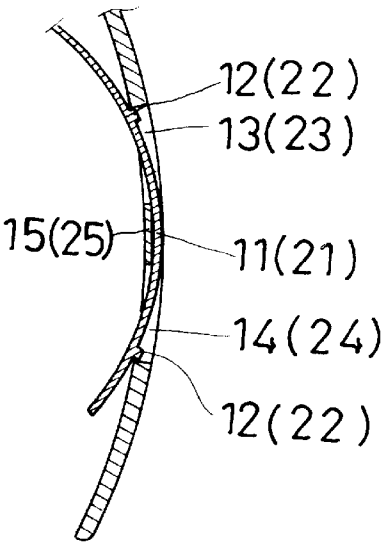
FIG. 5 is a partial cross-sectional view of the barrette combined together of the present invention.
Figure 4:
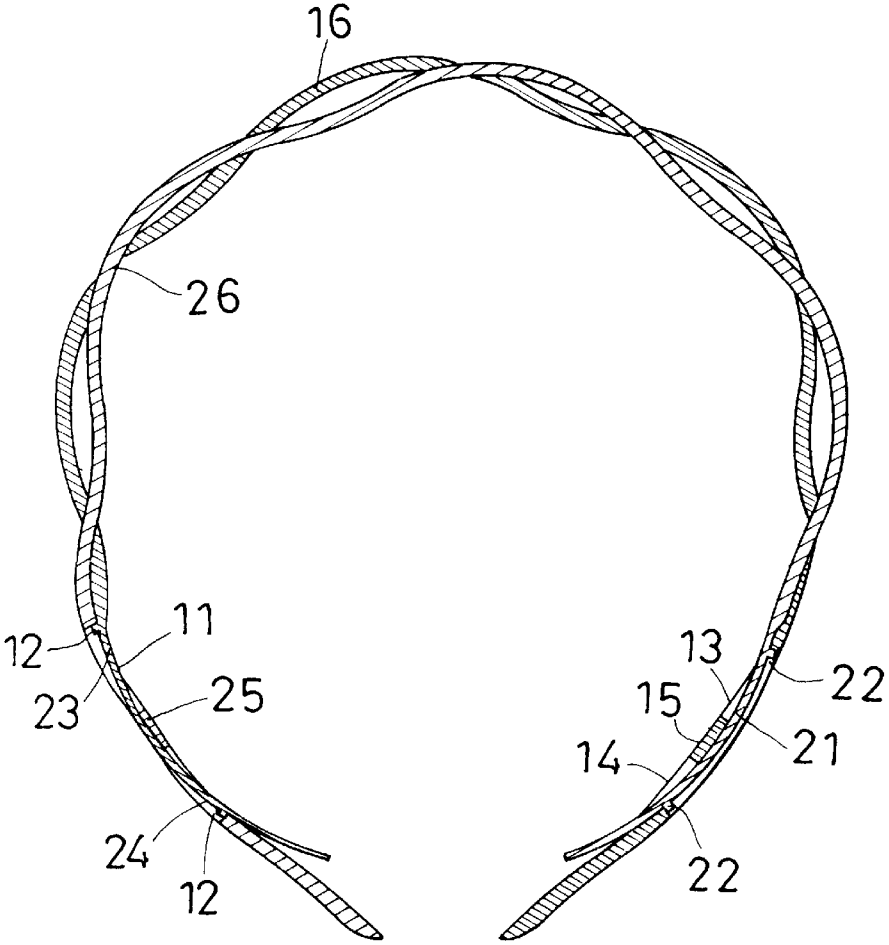
FIG. 4 is a front cross-sectional view of the barrette combined together of the present invention.

In combining, referring to FIGS. 2–5, the insertable end portion 11 of the first decorative elongate plate 1 is made to extend from inside through the first hole 23 of the second decorative elongate plate, pass over the lateral wall 25 and then through the second hole 24, with the two stop projections 12 stopped at an upper edge of the first hole 23 and at the lower edge of the second hole 23, 24, as shown in FIG. 5. Then, one end of the first and the second decorative elongate plates 1 and 2 are kept stabilized with each other.

Next, the intermediate twisted portions 16, 26 of the first and the second decorative plates 1 and 2 are made to intertwist and overlap with each other, forming an intertwisting and overlapping portion. Lastly, the insertable end portion 21 of the second decorative plate 2 is made to extend from inside and pass through the first hole 13 of the first decorative plate, pass over the lateral wall 15 and through second hole 14, with the two stop projections 22 stopped at an upper edge of the first hole 13 and at the lower edge of the second hole 14. Thus, the two decorative elongate plates 1 and 2 are combined with each other tightly and stabilized.

As can be understood from the aforesaid description, the barrette in the invention has the following advantages.

1. Makers can save the expenditure for one mold for making this barrette, as the barrette has two decorative elongate plates of the same structure possible to be made with only one mold.
2. Provision of the two decorativeelongate plates with various colors may change the whole visionary effect of the barrette, meeting different liking of consumers and enhancing competitiveness in the market.

What is claimed is:

1. A barrette comprising two decorative elongate plates of the same structure combined together, each of said two decorative elongate plates respectively having a flat insertable end portion, two lateral stop projections formed on an outer surface of said flat insertable end portion, a first hole and a second hole separated with a lateral wall formed in the other end portion, and an intermediate twisted portion; in combining said two decorative elongate plates, said insertable end portion of a first of said decorative elongate plates made to extend from inside through said first hole of a second of said decorative elongate plate, pass over said lateral wall and through said second hole, with said stop projections respectively stopped at an upper edge of said first hole and at a lower edge of said second hole to stabilize said insertable end portion of said first decorative plate with the holes end portion of said second decorative plate, said intermediate twisted portions of said two decorative plates made to intertwisting and overlapping with each other, lastly said insertable end portion of said second decorative plate made to extend from inside through said first hole of said first decorative plate, pass over said lateral wall and through said second hole of said first decorative plate, with said two stop projections respectively stopped at an upper edge of said first hole and at a lower edge of said second hole of said first decorative plate, forming said barrette.

* * * * *